United States Patent [19]

Lapinski et al.

[11] Patent Number: 4,671,504

[45] Date of Patent: Jun. 9, 1987

[54] ENVELOPE BIN FOR A FEEDER OF A PRINTER AND ASSOCIATED METHOD OF ENVELOPE FEED

[75] Inventors: Frank Lapinski, Smithtown; Anthony Graziano, Bay Shore, both of N.Y.

[73] Assignee: Primages, Inc., Ronkonkoma, N.Y.

[21] Appl. No.: 814,765

[22] Filed: Dec. 30, 1985

[51] Int. Cl.[4] ..... B65H 1/10

[52] U.S. Cl. ..... 271/126; 271/31.1; 271/149; 271/160; 271/161

[58] Field of Search ..... 271/149, 160, 161, 126, 271/31.1

[56] References Cited

U.S. PATENT DOCUMENTS

| | | | |
|---|---|---|---|
| 2,614,837 | 10/1952 | Cuthbert | 271/126 X |
| 4,026,438 | 5/1977 | Blume | 271/149 X |
| 4,352,022 | 9/1982 | Britton | 271/149 X |
| 4,511,135 | 4/1985 | Huerta | 271/161 X |

FOREIGN PATENT DOCUMENTS

| | | | |
|---|---|---|---|
| 82746 | 7/1981 | Japan | 271/126 |

*Primary Examiner*—Richard A. Schacher

*Attorney, Agent, or Firm*—Roberts, Spiecens & Cohen

[57] ABSTRACT

An envelope bin assembly for a printer comprising a bin member in which envelopes can be stacked in readiness for feed by an envelope feed roller of the printer, the bin member being engageable in a support of the printer such that the feed roller of the printer can engage the frontmost envelope in the stack to feed the same to a printing station of the printer. A pressure applying member is guidably supported for displacement in the bin member for applying pressure, under the action of gravity, to the stack of envelopes at the rear thereof thereby to press the frontmost envelope in the stack against the feed roller and bend the envelopes at the front of the stack around the feed roller to produce a fan effect at the lower edges of the envelopes by which the lower edges are spread apart to facilitate single feed of the frontmost envelope.

24 Claims, 5 Drawing Figures

ENVELOPE BIN FOR A FEEDER OF A PRINTER AND ASSOCIATED METHOD OF ENVELOPE FEED

FIELD OF THE INVENTION

The invention relates to an envelope bin for the supply of envelopes to a printer and, particularly, to an envelope bin of a combined sheet and envelope feed mechanism for a printer.

The invention also relates to a method of promoting the individual feed of the frontmost envelope in the stack so that the envelopes are fed one by one.

BACKGROUND OF THE INVENTION

Previously disclosed by the assignee of this application, in application Ser. No. 555,116 filed Nov. 23, 1983, is a three-bin feeder of which one bin is adapted for the supply of envelopes to the printing station of a printer. Therein, the envelope bin is held in a vertical position for feed of envelopes one by one to the printing station of the printer.

It has been found that the orderly feed of envelopes to the printing station of the printer at relatively high speed requires precise support of the envelopes in the stack with careful feed of the first envelope in the stack from the front of the stack, one by one, to the printing station in order to avoid jamming of the envelopes in the course of their feed from the envelope bin.

In the known art, various mechanisms have been employed to urge the stack of envelopes against the feed roller and these mechanisms rely on springs and adjustment means in order to regulate the biassing force and to keep the force active during the feeding operation of the envelopes.

SUMMARY OF THE INVENTION

An object of the present invention is to provide an envelope bin in which the envelopes are fed with precision and reliability, one by one, by a feed roller from the bin to the printing station.

A further object of the invention is to spread the edges of the envelopes to assure reliability of singular feed of the envelopes to the printing station by the feed roller.

A further object of the invention is to provide an envelope bin in which the envelopes are applied against the feed roller without the use of springs.

A further object of the invention is to provide an envelope bin in which the mechanism to press the envelopes against the feed roller is simple in construction and inexpensive in cost.

Another object of the invention is to provide an envelope bin which will satisfy the above objectives and be easy to operate.

The above and further objects of the invention are satisfied by a construction of an envelope bin assembly for a printer which comprises a bin member in which envelopes can be stacked in readiness for feed by the envelope feed roller of the printer, the bin member being engageable in a support of the printer such that the feed roller of the printer can engage the frontmost envelope in the stack to feed the same to a printing station of the printer. Slidably supported for displacement in the bin member is a pressure applying means for applying pressure to the stack of envelopes at the rear thereof to produce a bend in the envelopes at the front of the stack around the feed roller and provide a fan effect in which the edges of the envelopes are spread apart to facilitate individual feed of the frontmost envelope to the printing station of the printer and substantially eliminate any tendency for two envelopes to be fed together.

In accordance with a feature of the invention, the pressure applying means includes a weight element for developing the pressure under the action of gravity.

In further accordance with the invention, when the bin member is engaged in the support of the printer the envelopes are disposed substantially vertically in the stack and the pressure applying means is supported by an inclined surface on the bin member for slidable movement downwardly thereon, such that the weight element urges the pressure applying means to move downwardly along the inclined surface under the action of gravity.

In a particular construction according to the invention, the pressure applying means comprises a slide member which is slidably supported on the bin member and which carries the weight element.

The slide member comprises a formed plate having a flat base part and an upwardly extending front wall which is curved to come into tangential contact with the rearmost envelope in the stack to develop a force acting along a line of action which passes below the axis of rotation of the feed roller.

A friction element can be secured on the front wall of the slide member in order to provide frictional engagement between the wall and the rearmost envelope in the stack to prevent feed of the rearmost envelope.

In order to accommodate different size envelopes and to maintain the pressure under the action of gravity substantially centrally on the stack, the weight element is secured to the slide member for adjustment laterally thereof.

The invention is also directed to a method of feeding envelopes to a printer which comprises stacking the envelopes in a bin, pressing the stack of envelopes from the rear against the feed roller of the printer to produce a bend in the frontmost envelopes of the stack to provide a fan effect by which the edges of the envelopes are spread apart and the frontmost envelope in the stack can be reliably fed individually from the bin to a printing station of the printer.

The application of pressure to the stack of envelopes is effected under the action of gravity by a slidable weight element which bears continuously against the rear of the stack.

The invention will be described hereafter in relation to a specific embodiment thereof illustrated in the attached drawing.

DETAILED DESCRIPTION OF THE PREFERRED EMBODIMENT

Figure 1:
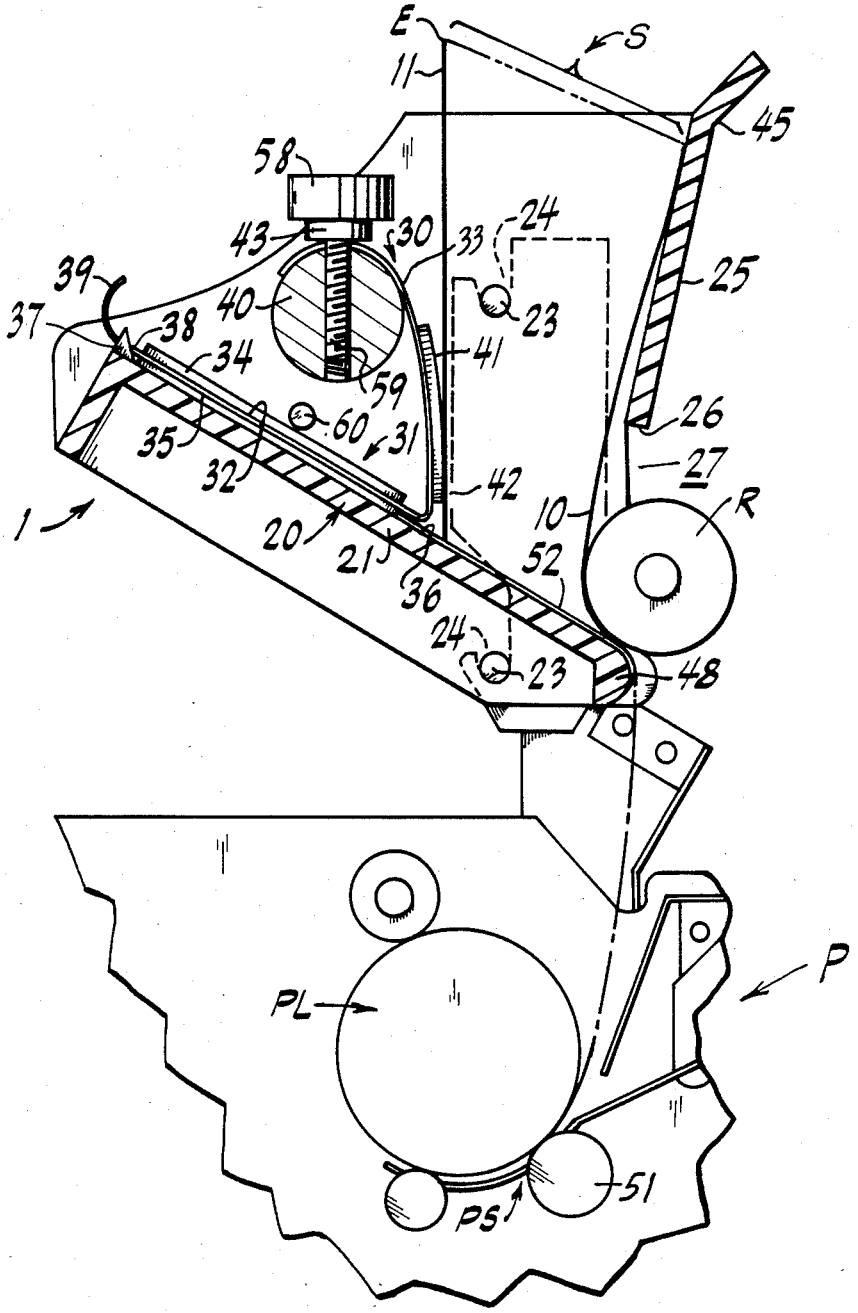
FIG. 1 is a side elevational view, partly in cross-section, of the envelope bin assembly according to a preferred embodiment shown in a latched, position.
Figure 2:
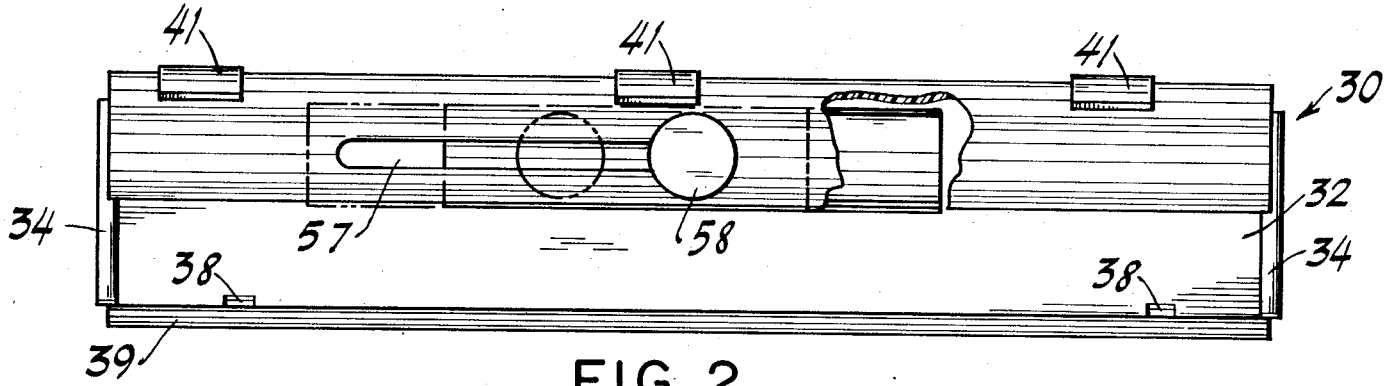
FIG. 2 is a top plan view, partly broken away, of a pressure applying means of the assembly in FIG. 1.

In the drawing is shown an envelope bin assembly 1 which cooperates with a printer P of which only the parts relevant to this invention are shown, such that envelopes E disposed in an upright stack S can be fed one by one from the bin assembly to a print station PS of the printer.

The printer incorporates a feed roller R which engages the frontmost envelope 10 in the stack S to feed the envelope along the path shown in chain-dotted outline in the drawing to the platen PL of the printer at the print station PS.

The bin assembly comprises a bin member 20 having a base or bottom wall 21 and a pair of opposite upwardly extending side walls 22. A pair of pins 23 are located on each side wall in outwardly extending arrangement in order to be accommodated in slots 24 in opposite walls of the printer to hold the bin assembly in a fixed orientation relative to the feed roller R and in which the envelopes E in stack S are disposed substantially vertically. The bin member has a front wall 25 against which the frontmost envelope 11 of the stack S can rest. A lower edge 26 of wall 25 is spaced above feed roller R to define a slot or opening 27 so that the feed roller can project into the bin member to feed the envelopes one by one in a manner to be explained in greater detail later.

Mounted within the bin member is a pressure applying means 30 which serves to apply pressure to the rearmost envelope 11 of the stack S in continuous fashion as the envelopes are fed one by one from the front of the stack by the feed roller R. The pressure applying means 30 comprises a slide member 31 constituted as a formed plate including a flat base part 32 and an upwardly extending front wall 33.

At the lateral edges of the flat base part are mounted plastic edge strips 34, 35 respectively at the top and bottom surfaces of the base part 32. The edge strips 35 at the underside of base part 32 slide along inclined surface 36 at the top of the base or bottom wall 21 of the bin member 20. The edge strips are composed of a suitable synthetic resin to minimize frictional forces and permit easy sliding of the slide member 31 with respect to the bin member 20. Accordingly, the slide member is freely displaceable along the surface 36 with a minimum of effort. As seen in FIG. 1, the slide member 31 is in a rearwards, latched position in which a pair of laterally spaced retainer lugs 37 on upper surface 36 at the rear of the base 21 engage in slots 38 formed in the base part 32 of the slide member. The slide member is formed with a curved portion 39 at its rear extremity for manual engagement to facilitate the retraction of the slide member to the latched position.

The plate construction of the slide member and particularly the curved portion 39 joined to the base part 32 provides resilience for the base part which permits release of the retainer lugs 37 from the slots 38 by an upward movement of the engaging portion 39 in order to release the slide member.

Secured to the slide member is a weight element 40 which acts under the influence of gravity to urge the slide member downwardly along the inclined surface 36. The weight member is suspended on the slide member so that the front wall 33 will come into tangential contact with the rearmost envelope 11 of the stack to apply a pressure force thereagainst which will continually urge the stack of envelopes against the roller R during the feed of the frontmost envelopes, one by one, to the printing station PS.

A friction means in the form of friction pads 41 of cork or similar material is affixed to the front wall 33 of the slide member in order to provide frictional engagement of the slide member with the rearmost envelope 11 in the stack to prevent feed of the last envelope in the stack by the feed roller. This will insure that when there are only two envelopes left in the stack they won't be both fed together by the feed roller to the printing station.

Figure 5:
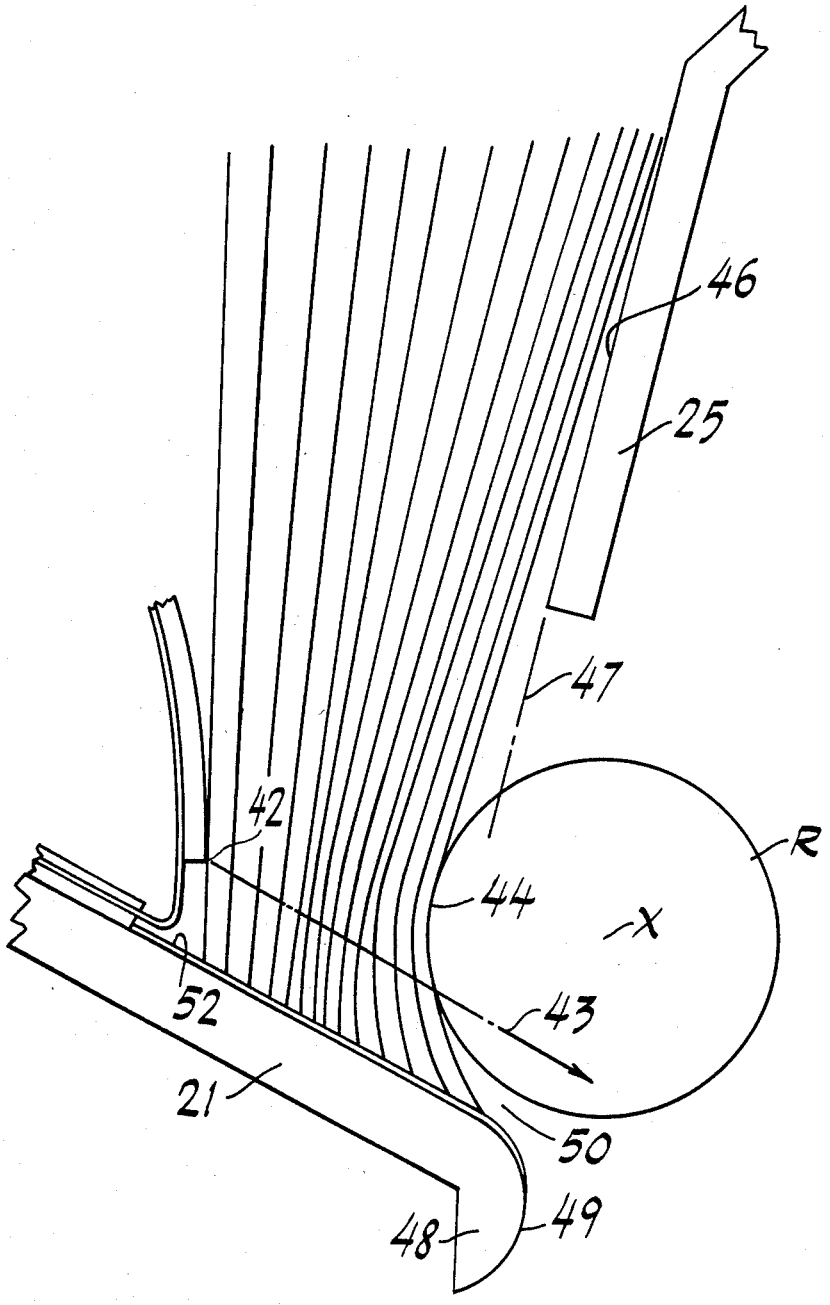
FIG. 5 is a detail on enlarged scale of a portion of the assembly in FIG. 1.

The feed roller R, bin member 20 and pressure applying means 30 are cooperatively positioned and arranged to constitute a means for forming a bend in the envelopes at the front of the stack as best seen in FIG. 5 to produce a fan effect at the lower edges of the envelopes by which the edges are spread apart. This causes a pre-separation of the lower edges of the envelopes at the front of the stack in which the lower edge of the frontmost envelope in particular is bent away from the rest of the stack and is in position for feed through gap 50 to the print station. This will insure individual feed of the envelopes, one by one, by the roller R to the print station.

In order to achieve the fan effect, the envelope at the front of the stack must undergo a bending around the feed roller R. This is obtained by the projection of roller R through the opening 27 into the bin member and by the contact of the friction pads 41 with the rearmost envelope of the stack at a location 42 to develop a force acting along a line of action 43 (FIG. 5) which will pass below the axis of rotation X of the feed roller R and also below the line of contact 44 of the frontmost envelope of the stack with the feed roller R.

In order to facilitate the fan effect, the front wall 25 has a bend 45 therein (FIG. 1) so that the inner surface 46 of wall 25 will lie in a plane 47 which intersects the roller R.

The front edge 48 of the base 21 of the bin member has a curved surface 49 facing the feed roller R from below to define the feed gap 50 through which the frontmost envelope is fed, lower edge first, to the print station. The curved surface 49 cooperates with the fanned lower edge of the frontmost envelope to feed this envelope without any substantial resistance to the print station. In its feed, the frontmost envelope remains engaged with the roller R until the leading edge of the envelope has engaged the platen PL at the printing station by entry between the nip of the platen PL and a drive roller 51. In this way, the envelope is held in secure position until it is taken up at the print station and released from roller R.

The upper surface 36 of the bin member is provided with spaced strips 52 of low friction material which extend on and around the curved surface 49 at the edge 48 of the bottom wall 21. The strips 52 can be made of polyimide film of 0.003 inches thickness and serve to reduce friction between the lower edges of the envelopes and bottom wall 21.

When the envelopes are stacked in the bin assembly their left edges (FIG. 3) are aligned with a guide surface 55 on wall 22. The weight member 40 is positioned on the slide member so that it occupies a central position laterally with respect to the envelopes. When different size envelopes are employed, the weight element 40 is shifted laterally in order to occupy a central position for the particular size envelopes. In order to achieve this positioning, the front wall of the slide member is provided with a slot 57 at the top thereof through which is fitted a bolt 58 which is threadably secured into a tapped hole 59 in the weight member. Thus, by loosening the bolt 58, the weight 40 can be shifted laterally to occupy a central position with respect to the size of the selected envelope. Once this position has been reached, the bolt 58 is tightened to lock the weight 40 in its selected position.

A marking means (not shown) can be printed on the top of the front wall of the slide member adjacent the slot to indicate the position of the bolt 48 for different envelope sizes.

In order to guide the sliding movement of the slide member on the bin member without restricting its free-sliding movement, a pair of pins 60 are located in the side walls 22 of the bin member and the pins 60 face inwardly at a position just above the upper surfaces of the edge strips 34. Thereby the pins 60 serve to retain the slide member on the bin member and constitute guides without interfering with the free sliding movement of the slide member.

The operation of the bin assembly is as follows:

The bin member is inserted into the printer by engaging the outer pins 23 in the slots 24 in the side walls of the printer in order to secure the bin member in the position shown in FIGS. 1 and 5 . The slide member 30 is held in its rearward, latched position as shown in FIG. 1 by manual retraction of the slide member to engage the retainer lugs 37 in the slots 38.

Figure 3:
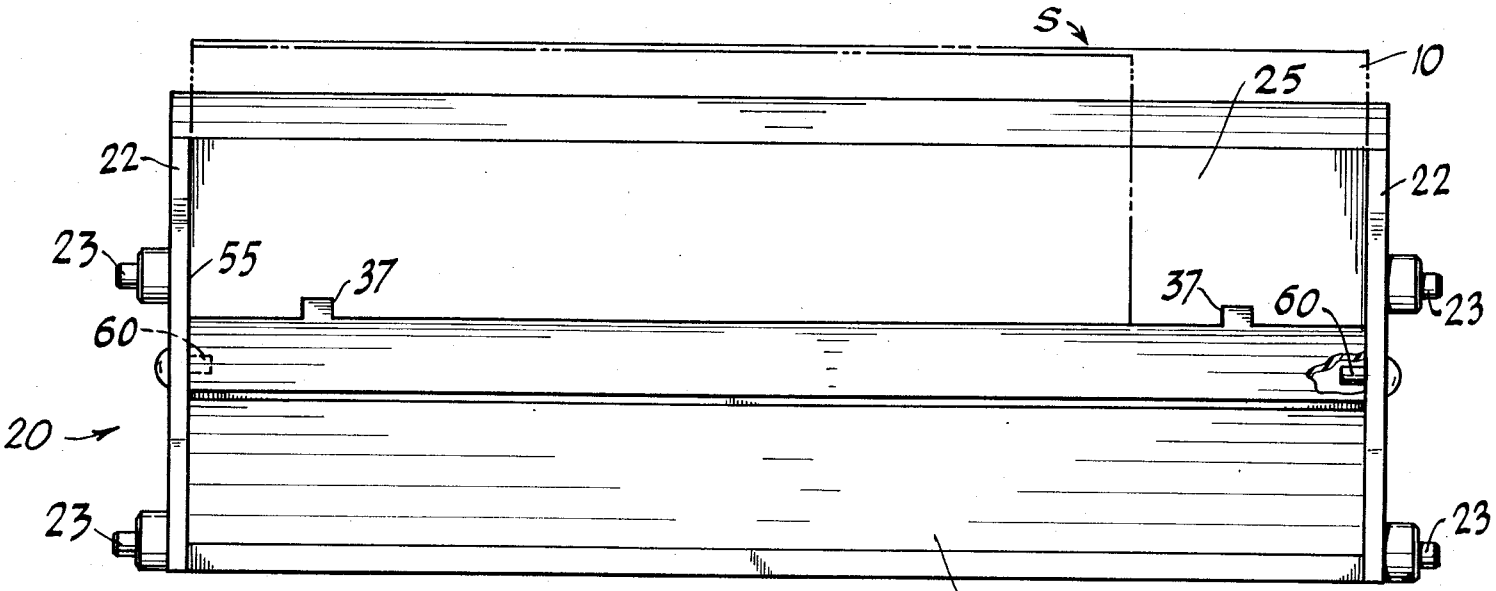
FIG. 3 is a rear elevational view partly broken away of a bin member of the assembly in FIG. 1.
Figure 4:
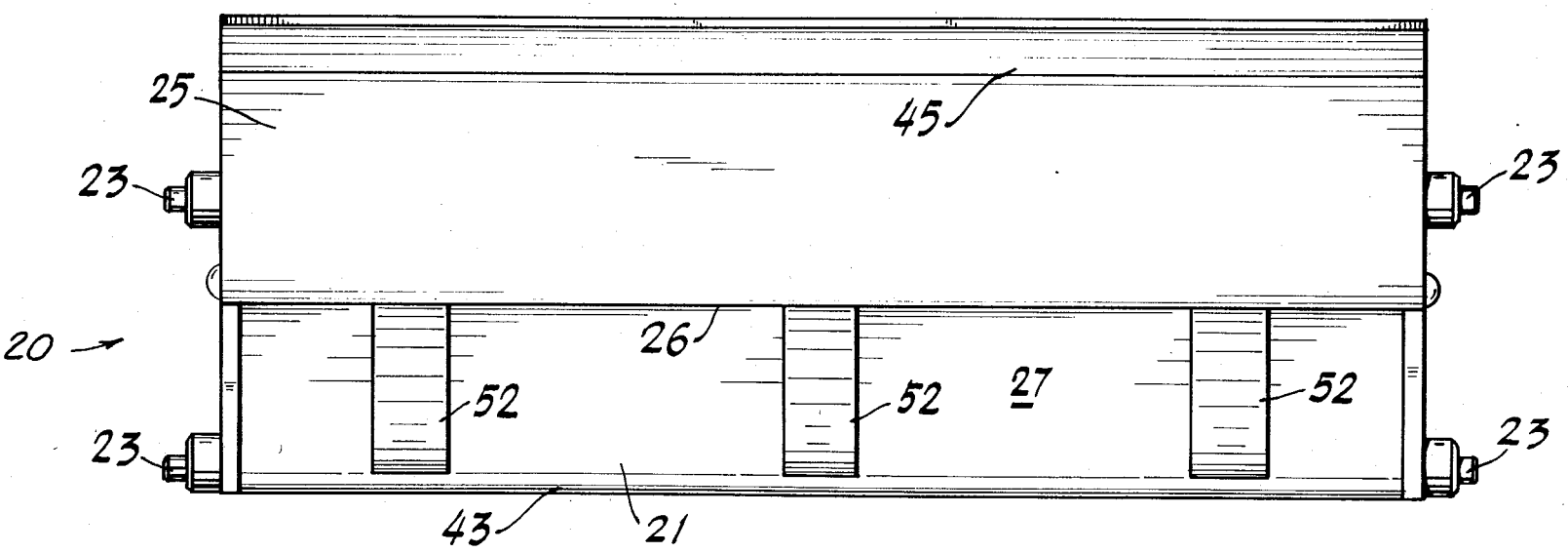
FIG. 4 is a front elevational view of the bin member in FIG. 3.

The stack of envelopes S is then vertically inserted into the bin member and the left edges of the envelopes are aligned against guide surface 55 as shown in FIG. 3.

The weight element 40 is laterally adjusted, if necessary, so that it occupies a central position with respect to the stack of envelopes S and the bolt 58 is tightened to secure the weight element in place.

The curved portion 39 at the back of the slide member is bent upwardly to release the retainer lugs 37 from the slots 38. In order to facilitate the latching and unlatching operation, the front surface of the retainer lugs 37 is inclined with respect to the upper surface 36 of the bottom 21 of the bin member.

Upon release of the slide member from the retainer lugs 37, the slide member travels along inclined surface 36 until the friction pads 41 come into contact with the rearmost envelope 11 of the stack S at locations 42. This will cause the lower edges of the envelopes at the front of the stack to undergo the fan effect to space apart the lower edges.

The envelope bin is now in readiness for feed of envelopes from the bin to the printing station. This is achieved by sending a signal to a drive motor (not shown) for roller R to cause roller R to undergo rotation and advance the frontmost envelope 10 along the path of travel shown in chain dotted lines in FIG. 1 to the print station PS, whereat the envelope is printed and advanced to a receiving station (not shown). The frontmost envelopes in the stack are fed one by one with each successive drive of roller R. In the course of the feed, the slide member 30 is continuously urged under the action of gravity against the rearmost envelope of the stack to apply a substantially uniform pressure to the stack to maintain the fan effect and achieve individual feed of the frontmost envelopes one by one from the stack.

In contrast with conventional arrangements which use springs to bias the pressure applying means, and where the biassing force varies in accordance with the continuously reducing stack, the pressure applying means of the invention applies a uniform and constant force to the stack due to the arrangement wherein the force is developed by the weight element 40 which acts under the influence of gravity to develop the biassing force.

Additionally, it is seen that the construction is very simple and the slide member is easy to operate and has substantially little frictional resistance.

The construction of the invention has overcome the problem associated with known constructions of feeding the envelopes through the feed gap by their lower edges with the tendency of two envelopes to be fed together. This is solved by the fan effect by which the lower edges are spread apart into a pre-separation condition in which the lower edge of the frontmost envelope is curved forwards for individual feed through gap 50.

Although the invention has been described in relation to a specific embodiment thereof, it will become apparent to those skilled in the art that numerous modification and variations can be made within the scope and spirit of the invention as defined in the attached claims.

Thus, while the invention has been described with reference to envelopes, it will be apparent that the invention is applicable to individual sheets or other articles as well as envelopes.

What is claimed is:

1. An envelope bin assembly for a printer having an envelope feed roller, said assembly comprising a bin member in which envelopes can be stacked for readiness for feed by the envelope feed roller of the printer, said bin member having a bottom with a surface on which edges of the envelopes slidably rest, said bin member being engageable in a support of the printer such that the feed roller of the printer can engage the frontmost envelope in the stack to feed the same to a printing station of the printer, and pressure applying means guidably supported for displacement in said bin member for applying pressure to said stack of envelopes at the rear thereof to press the frontmost envelope in the stack against the feed roller, said bin member having a wall with an opening therein through which the envelope feed roller protrudes to contact the frontmost envelope in said stack, at a position in the bin member to cooperate therewith and with the pressure applying means to constitute a means for forming a bend in the stack of envelopes for producing a fan effect in which said edges of the envelopes are spread apart to facilitate feed thereof individually by said feed roller, said pressure applying means having a front surface which contacts the rear of the stack, said front surface being shaped and of an extent so that the pressure applied by said front surface to the rear of the stack produces a force acting along a line of action which extends in the vicinity of said edges of the envelopes between said surface of the bin member and said axis of rotation of the feed roller.

2. An envelope bin assembly as claimed in claim 1 wherein said envelopes are upright in said stack in the bin member and said edges of the envelopes are lower edges thereof which are spread apart by said fan effect.

3. An envelope bin assembly as claimed in claim 2 wherein said shape and extent of the front surface of said pressure applying means is such that the application of pressure to the envelopes is confined to a region between said inclined surface and said axis of rotation of said feed roller.

4. An envelope bin assembly as claimed in claim 3 wherein the contact of said feed roller with the stack is above said line of action of said force.

5. An envelope bin assembly as claimed in claim 2 wherein said surface of said bin member is inclined and said pressure applying means is slidably supported on said inclined surface.

6. An envelope bin assembly as claimed in claim 5 wherein said wall has a flat surface which lies in a plane which intersects said feed roller.

7. An envelope bin assembly as claimed in claim 6 wherein said bottom has a rounded edge adjacent said feed roller to form a feed gap through which the frontmost envelope in the stack is fed individually by said feed roller, said rounded edge accommodating said fan effect and achieving spacing of the lower edge of said frontmost envelope from the rest of the envelopes to facilitate individual feed of said frontmost envelope.

8. An envelope bin assembly as claimed in claim 6 comprising means on said inclined surface to reduce friction between the lower edges of the envelopes and the inclined surface.

9. An envelope bin assembly as claimed in claim 8 wherein said means to reduce friction comprises strips of low friction material on said inclined surface extending around said rounded edge.

10. An envelope bin assembly as claimed in claim 1 wherein said pressure applying means includes a weight element for developing said pressure under the action of gravity.

11. An envelope bin assembly as claimed in claim 10 wherein said envelopes are upright in said stack in the bin member and said edges of the envelope are lower edges thereof which are spread apart by said fan effect, said surface of said bin being inclined and on which said pressure applying means is slidably supported, said pressure applying means comprising a manually engageable portion for pulling said pressure applying means upwardly on said inclined surface against the action of gravity.

12. An envelope bin assembly as claimed in claim 11 wherein said pressure applying means comprises a slide member slidably supported on said bin member and carrying said weight element.

13. An envelope bin assembly as claimed in claim 12 wherein said manually engageable portion is on said slide member.

14. An envelope bin assembly as claimed in claim 13 comprising latching means on said slide member and bin member for releasably holding said slide member in a retracted, stationary position on said bin member.

15. An envelope bin assembly as claimed in claim 12 wherein said slide member comprises a formed plate including a flat base part and an upwardly extending front wall.

16. An envelope bin assembly as claimed in claim 15 comprising slide means on said base part for sliding on said bin member.

17. An envelope bin assembly as claimed in claim 16 comprising guide and retainer means on said bin assembly for guiding and retaining said slide member during sliding movement thereof on said bin member.

18. An envelope bin assembly as claimed in claim 15 comprising friction means on said front wall for frictionally engaging the rearmost envelope in said stack.

19. An envelope bin assembly as claimed in claim 18 wherein said front wall is curved to come into tangential contact with the rearmost envelope in the stack.

20. An envelope bin assembly as claimed in claim 10 comprising means detachably connecting said weight element to said pressure applying means.

21. An envelope bin assembly as claimed in claim 10 comprising means connecting said weight element to said pressure applying means for adjustment laterally of the pressure applying means.

22. A method of feeding envelopes to a printer comprising stacking the envelopes upright in a bin with the lower edges of the envelopes resting on a surface of the bin, pressing the stack of envelopes from the rear against a feed roller of the printer with a force to bend the envelopes at the front of the stack around the feed roller to produce a fan effect in which the lower edges of the envelopes at the front of the stack are spread apart, and periodically rotating the feed roller to feed the frontmost envelopes in the stack, one by one, to a printing station of the printer, the force applied to the rear of the envelopes acting in the vicinity of the lower edges of the envelopes in a limited region between the surface of the bin and the axis of rotation of the feed roller.

23. A method as claimed in claim 22 comprising frictionally engaging the rearmost envelope in the stack to prevent its feed with the previous envelope to the printing station.

24. A method as claimed in claim 22 wherein said pressing of the stack of envelopes from the rear is effected under the action of gravity by a slidable weight element bearing continuously against the rear of the stack.

* * * * *